US010264370B2

(12) United States Patent
Olsen et al.

(10) Patent No.: US 10,264,370 B2
(45) Date of Patent: Apr. 16, 2019

(54) HEARING DEVICE CONFIGURED TO BE PLACED IN THE EAR CANAL OF A USER

(71) Applicant: Oticon A/S, Smørum (DK)

(72) Inventors: Thor Højlund Olsen, Smørum (DK); Povl Koch, Smørum (DK); Søren Stranne, Smørum (DK); Troels Holm Pedersen, Smørum (DK); Kåre Tais Christensen, Smørum (DK); Lars Lund Jørgensen, Smørum (DK); Jan Frantzen, Smørum (DK); Karsten Bo Rasmussen, Smørum (DK); Bent Severin, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 15/132,956

(22) Filed: Apr. 19, 2016

(65) Prior Publication Data

US 2016/0309268 A1 Oct. 20, 2016

(30) Foreign Application Priority Data

Apr. 20, 2015 (EP) ..... 15164209

(51) Int. Cl.
*H04R 25/00* (2006.01)

(52) U.S. Cl.
CPC ..... *H04R 25/60* (2013.01); *H04R 25/505* (2013.01); *H04R 25/602* (2013.01); *H04R 25/65* (2013.01);
(Continued)

(58) Field of Classification Search
CPC .... H04R 25/60; H04R 25/602; H04R 25/604; H04R 25/65; H04R 25/658;
(Continued)

(56) References Cited

U.S. PATENT DOCUMENTS 5,701,348 A * 12/1997 Shennib ..... H04R 25/456 381/322
5,825,896 A 10/1998 Leedom
(Continued)

FOREIGN PATENT DOCUMENTS

DE 102005009377 B3 9/2006
EP 2538701 A2 12/2012
(Continued)

*Primary Examiner* — Fan S Tsang
*Assistant Examiner* — Angelica M McKinney
(74) *Attorney, Agent, or Firm* — Birch, Stewart, Kolasch & Birch, LLP

(57) ABSTRACT

The application relates to a hearing device configured to be placed in the ear canal of a user, the hearing device comprising a forward path adapted for processing an input sound and providing an output sound representative of the input sound, the hearing device comprising an assembly comprising first and second modules adapted for being in mechanical contact with each other when the hearing device is operationally assembled to form a functional unit. The object of the present application is to provide a user friendly hearing device adapted for being located in an ear canal of the user. The problem is solved in that the first module comprises a power supply unit, and the second module comprises an input unit, a signal processing unit and an output unit in operational connection, wherein the first and second modules are configured to provide that the first and second modules are reversibly attachable to and detachable from each other; and the first and second modules are electrically connected to provide that units of the second module are energized by the battery of the first module, when the first and second modules are operationally assembled. This has the advantage of providing relatively simple and easy to use hearing device. The invention may e.g. be used for hearing aids, in particular extended wear
(Continued)

hearing aids adapted for being located deep in the ear canal of a user.

25 Claims, 4 Drawing Sheets

(52) U.S. Cl.
CPC ..... *H04R 25/658* (2013.01); *H04R 2225/023* (2013.01); *H04R 2225/33* (2013.01); *H04R 2225/55* (2013.01)

(58) Field of Classification Search
CPC ... H04R 2225/023; H04R 25/30; B23P 17/00; A61B 5/6817
See application file for complete search history.

(56) References Cited

U.S. PATENT DOCUMENTS 5,881,159 A * 3/1999 Aceti ..... A61B 5/6817 381/322
6,041,128 A * 3/2000 Narisawa ..... H04R 25/602 381/322
6,212,283 B1 4/2001 Fletcher et al.
6,410,997 B1 * 6/2002 Sjursen ..... H01M 2/1044 307/130
7,010,137 B1 * 3/2006 Leedom ..... A61B 5/6817 381/322
7,194,101 B2 * 3/2007 Vonlanthen ..... H04R 25/608 381/322
7,424,124 B2 * 9/2008 Shennib ..... H04R 25/60 381/322
8,498,436 B2 * 7/2013 Cheng ..... H04R 25/608 381/322
8,630,434 B2 1/2014 Rasmussen et al.
8,848,956 B2 * 9/2014 Higgins ..... H04R 25/602 181/129
2005/0147267 A1 7/2005 Gudmundsen et al.
2013/0101128 A1 * 4/2013 Lunner ..... H04R 25/30 381/60
2013/0125387 A1 * 5/2013 Wenzel ..... B23P 17/00 29/623.1
2013/0129128 A1 5/2013 Wagner et al.
2013/0243229 A1 * 9/2013 Shennib ..... H04R 25/602 381/323
2014/0254843 A1 9/2014 Shennib et al.

FOREIGN PATENT DOCUMENTS

WO WO 00/42817 A1 7/2000
WO WO 00/76271 A1 12/2000

* cited by examiner

HEARING DEVICE CONFIGURED TO BE PLACED IN THE EAR CANAL OF A USER

TECHNICAL FIELD

The present application relates to hearing devices, in particular to hearing devices configured to be placed in the ear canal of a user in relatively close proximity of an ear drum of the user. The disclosure relates specifically to: A hearing device configured to be placed in the ear canal of a user, the hearing device comprising a forward path adapted for processing an input sound and providing an output sound representative of the input sound, the hearing device comprising an assembly comprising first and second modules adapted for being in mechanical contact with each other when the hearing device is operationally assembled to form a functional unit.

Embodiments of the disclosure may e.g. be useful in applications such as hearing aids.

BACKGROUND

Hearing devices come in many types and styles, large, small, thoroughly designed, visible, hidden, etc. A particular solution is typically chosen according to the need and wishes of a user. Some uses want an inconspicuous hearing instrument, which they do not need to handle/care about (mount demount, change/charge battery, clean, etc.).

EP2538701A2 describes a completely in the ear canal type hearing instrument, adapted for being located at least partially in the bony part of the ear canal. The hearing instrument is a self-contained instrument comprising microphone, battery, signal processing unit, and loudspeaker (and possibly other relevant functional parts for providing appropriate amplification (or attenuation) of an input sound and presenting it as a processed output sound to the residual volume of the ear canal close to the ear drum).

U.S. Pat. No. 8,630,434B2 describes a modular hearing device comprising an ear mould and an output module. The mould is arranged to have an opening with an inner surface, the dimensions and form of outer surface of the output module, the opening and the inner surface of the mould being adapted to allow the output module to be mounted in the opening, preferably tightly, at least over a part of their common spatial extension. At least one venting channel is arranged adjacent to the outer surface of the output module, so that sound waves can pass by the output module when inserted in a mould for insertion in a user's ear. The output module comprises functional components of the hearing device, at least including an output transducer.

SUMMARY

An object of the present application is to provide a user friendly hearing device adapted for being located in an ear canal of the user.

Objects of the application are achieved by the invention described in the accompanying claims and as described in the following.

A Hearing Device:

In an aspect of the present application, an object of the application is achieved by A hearing device configured to be placed in the ear canal of a user, the hearing device comprising a forward path adapted for processing an input sound and providing an output sound representative of the input sound, the hearing device comprising an assembly comprising first and second modules adapted for being in mechanical contact with each other when the hearing device is operationally assembled to form a functional unit, wherein the first module comprises a power supply unit, and the second module comprises an input unit, a signal processing unit and an output unit in operational connection, wherein the first and second modules are configured to provide that

- the first and second modules are reversibly attachable to and detachable from each other; and
- the first and second modules are electrically connected to provide that units of the second module are energized by the battery of the first module, when the first and second modules are operationally assembled.

This has the advantage of providing a relatively simple and easy to use hearing device.

The term 'the first and second modules are operationally assembled' is in the present context taken to mean that the modules in question are in a physical (e.g. mechanical and electrical) state allowing them to perform their intended function (here functions of a hearing device, e.g. a hearing aid).

In an embodiment, the first and second modules each comprises appropriate electric contacts and corresponding electric conductors allowing the power supply unit (e.g. a battery or other element for supplying electric power) to supply the electronic components (including the input transducer, the signal processing unit, and the output transducer) of the second module with electric power when the first and second modules are operationally assembled.

In an embodiment, the power supply unit comprises a battery. Preferably, the battery comprises a non-rechargeable battery, such as a Zn-air battery. Alternatively, the battery may comprise a rechargeable battery, e.g. a nickel-metal hydride (Ni—MH) or a Li-Ion battery.

In an embodiment, the first module comprises a first module container enclosing the power supply unit, and the second module comprises a second module container enclosing the input unit, the signal processing unit, and the output unit. The term 'module container' is taken in a broad sense to mean an outer shell or body that encloses components or units of the module and determines the outer extension (the volume that the module consumes (takes up). The first and second module containers may preferably be configured to allow the first module container to circumvent or carry the second module container. Within this context the term "circumvent" should be construed in the sense that the first module at least in one embodiment substantially surrounds and/or enclose the second module, when in an assembled state. In addition, with the term 'carry' it should be understood that the first module, in the assembled condition, such as when mounted in an ear canal of a user, carries the weight of the second module. In addition, the first and second modules are in this way arranged in relation to each other such that the second module substantially does not come into contact with the walls of the ear canal when the hearing device is inserted therein.

Thus, in an embodiment, the first module is configured to fully surround the second module when in an assembled state.

In an embodiment, the hearing device is configured to provide that the first module carries the second module, when the first and second modules are operationally assembled. The term 'the first module carries the second module' is in the present context taken to mean that the first module is larger than the second module (as determined by the volume defined by its outer boundaries).

In an embodiment, the first module is decisive in determining the location in the ear canal of the assembly of the first and second modules. In an embodiment, the first module acts as an enclosure or housing for the second module (as previously defined).

The term the hearing device (and/or the assembled first and second modules) is operationally mounted in an ear canal of the user' is in the present context taken to mean that the hearing device (and/or the assembled first and second modules) is located in the ear canal so that it separates an open portion of the user's ear canal (which opens to the outside and receives the prevailing sound surrounding the user) and a closed portion of the user's ear canal (between the hearing device and the ear drum of the user).

In an embodiment, the hearing device is configured to provide that the first module encloses the second module, when the first and second modules are operationally assembled. Accordingly, in an embodiment, the first module comprises a cavity adapted to receive the second module. 'In an embodiment, the first module comprises an (possibly through-going) opening adapted to receive the second module and to provide that the first and second modules are electrically connected when the second module is located in the opening of the first module. In an embodiment, the first module comprises a through-going (elongate) opening adapted to receive the second module. In an embodiment, the second module only partially fills the through-going opening in an elongate direction. In an embodiment, a length of the through-going opening is left unfilled by the second module, when the first and second modules are operationally assembled. The unfilled length of the through-going opening thereby provides a speaker outlet channel of the hearing device.

Within this context it is apparent that the through-going cavity of the first module, is preferably in a direction parallel with a longitudinal direction of the hearing device. Thus, if taken in relation to the ear canal of a user and the hearing device inserted therein, the through going cavity of the first module, substantially comprises a length direction being parallel with the length of the ear canal.

In an embodiment, the input unit comprises an input transducer for converting an input sound to an electric input audio signal, and the output unit comprises an output transducer for converting a processed audio signal to an output sound. In an embodiment, the input transducer comprises a microphone. In an embodiment, the output unit comprises a loudspeaker.

In an embodiment, the hearing device is configured to allow an input sound from the local environment of the input unit of the hearing device to reach the input unit and output sound from the output unit of the hearing device to reach the local environment of the output unit. In an embodiment, the hearing device comprises an inlet structure for the input unit for guiding sound from the local environment to the input unit. In an embodiment, the hearing device comprises an outlet structure for the output unit for guiding sound from the output unit to the local environment. In an embodiment, the second module container comprises specifically adapted sound-permeable areas at the input and output units (e.g. at the entry to the inlet structure and at the exit from the outlet structure (when viewed in a direction of sound propagation). In an embodiment, the sound-permeable areas comprises a number of specifically distributed and sized holes.

In an embodiment, the first module comprises a mechanically flexible outer part configured to provide a resilient interface towards walls of the ear canal of the user. In an embodiment, the flexible outer part of the first module is made of or comprises a resilient silicone or foam or rubber material. In an embodiment, the flexible outer part of the first module has the function of a dome or other structure for spatially guiding the assembly of first and second modules in an ear canal of the user. In an embodiment, the flexible outer part of the first module form part of the first module container. Thus, in accordance with an embodiment, the first module has an outer flexible part, such as a dome structure, wherein a substantially harder part is integrated in the outer flexible part. The integration may includs for example a power supply, such as a battery. The hard inner part and flexible outer part of the first module should thus be understood to be a single unit. Accordingly, the first module is preferably molded and/or glued together with power supply, so as to create a one-piece component.

In an embodiment, the first module comprises an inner part that provides a mechanical interface towards the second module, wherein the inner part is less mechanically flexible than the outer part. In an embodiment, the outer part of the carrier has a smaller elastic modulus (or Young's modulus) than the inner part.

In an embodiment, the first module comprises one or more filters for mechanically protecting respective (e.g. acoustic) inlets or outlets of the second module during use of the hearing device. In an embodiment, the one or more filters comprises a wax filter. In an embodiment, the first module comprises a wax filter for protecting the output unit, e.g. an output transducer (e.g. a loudspeaker) outlet of the second module. In an embodiment, the first module comprises a wax filter for protecting the input transducer (e.g. a microphone) inlet of the second module. In an embodiment, the second module comprises a filter for protecting the output unit, e.g. an output transducer (e.g. a loudspeaker) outlet. In an embodiment, the second module comprises a filter for protecting the input unit, e.g. an input transducer (e.g. a microphone) inlet.

In an embodiment, the forward path of the second module is energized from the power supply unit of the first module and consists of a microphone for picking up an input sound from the environment and providing an electric input signal, a signal processing unit for processing the electric input signal and providing a processed electric signal, and a loudspeaker for converting the processed electric signal to an output sound.

In an embodiment, the second module container comprises a material (e.g. an epoxy) for sealing the electronic components, while leaving acoustic waves to and from the input and output transducers, respectively, largely un-attenuated. In an embodiment, the second module container is configured to allow sound to reach the input transducer and sound to leave the output transducer. The second module is not intended to comprise a wireless transceiver of electromagnetic signals. In an embodiment, the second module is configured to contain only one microphone. In an embodiment, the second module is configured to contain only one loudspeaker.

In an embodiment, the first module is configured to be disposable. In an embodiment, the first module, including the power supply unit, is made of disposable materials. This has the advantage that no space for charging contacts for wired charging or coils for wireless charging of the power supply unit (e.g. a rechargeable battery) is necessary. In this context, it should be understood that the first module includes a power supply, in the sense that the power supply is integrated into the structure of the first module.

In an embodiment, the power supply unit is a conventional (disposable) battery (e.g. a Zn-Air battery). In an embodiment, the first hearing device is configured to allow a minimum time between necessary exchange (disposal) of the first module of one week, such as two or three weeks.

In an embodiment, the hearing device according is configured to be powered on during wear. In an embodiment, the hearing device is configured to be powered on before it is operationally mounted in the ear canal of the user. In an embodiment, the hearing device is configured to be powered on when the first and second modules are operationally assembled. This has the advantage that no space for a user interface (e.g. comprising an activation element) for controlling the function of the hearing device (including turning it on or off) is necessary. In an embodiment, the hearing device is configured for extended wear (e.g. in that it is intended for being worn day and night). In an embodiment, the hearing device is configured to be powered on and off (e.g. only) when the first and second modules are operationally assembled and disassembled, respectively.

In an embodiment, the hearing device is configured to be automatically set in a reduced power mode when a predefined criterion is fulfilled. In an embodiment, the predefined criterion comprises that a level of acoustic input sound is below a predefined threshold (e.g. for a minimum of time).

In an embodiment, the hearing device comprises a first structural element for mounting and/or dismounting the hearing device in and from, respectively, the ear canal of the user. In an embodiment, the first structural element is configured to allow a mounting and/or demounting of the assembled first and second modules. In an embodiment, the first structural element is located in the first module. In an embodiment, the first structural element provides a pull-out and insertion interface to a mounting/dismounting tool for use when the hearing device is to be mounted or dismounted in or from an ear canal of the user.

In an embodiment, the hearing device comprises a second structural element for assembling and/or dis-assembling the first and second modules. In an embodiment, the second structural element is located in the second module. In an embodiment, the second structural element provides an assembly and disassembly interface to an assembling- disassembling tool for use to assemble and/or disassemble (separate) the first and second modules. In an embodiment, the first structural element for mounting and/or dismounting the hearing device in and from, respectively, the ear canal of the user is identical to the second structural element for assembling and/or dis-assembling the first and second modules. In an embodiment, the same tool can be used to mount-dismount the hearing device and to assemble-disassemble the first and second modules.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. The hearing device comprises a signal processing unit for enhancing the input signals and providing a processed output signal.

In an embodiment, the hearing device comprises an output unit for providing a stimulus perceived by the user as an acoustic signal based on a processed electric signal. In an embodiment, the output transducer comprises a receiver (loudspeaker) for providing the stimulus as an acoustic signal to the user.

In an embodiment, the input unit comprises an input transducer for converting an input sound to an electric input signal. In an embodiment, the input transducer comprises a microphone.

In an embodiment, the hearing device (e.g. as determined by the 1$^{st}$ module) has a maximum outer dimension of the order of 0.02 m or less, such as 0.01 m or less.

The hearing device is a portable device comprising a local energy source, e.g. a battery, e.g. a rechargeable battery.

The hearing device comprises a forward or signal path between an input unit (microphone system and/or direct electric input (e.g. a wireless receiver)) and an output unit. The signal processing unit is located in the forward path. In an embodiment, the signal processing unit is adapted to compensate for a user's hearing impairment. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the acoustic environment.

In a particular embodiment, the hearing device comprises a voice detector (VD) for determining whether or not an input signal comprises a voice signal (at a given point in time). A voice signal is in the present context taken to include a speech signal from a human being. In an embodiment, the voice detector is adapted to detect as a VOICE also the user's own voice. Alternatively, the voice detector is adapted to exclude a user's own voice from the detection of a VOICE.

In an embodiment, the hearing device further comprises other relevant functionality for the application in question, e.g. compression, noise reduction, etc. Use:

In an aspect, use of a hearing device as described above, in the 'detailed description of embodiments' and in the claims, is moreover provided. In an embodiment, use is provided in a system comprising one or more hearing instruments, A Hearing System:

In a further aspect, a hearing system comprising a hearing device as described above, in the 'detailed description of embodiments', and in the claims, AND an auxiliary device is moreover provided. In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device comprises a remote control and/or a programming device. In an embodiment, the communication link is based on sound signals. In an embodiment, the communication link is based on audible sound signals. In an embodiment, the communication link is based on in-audible sound signals. In an embodiment, the communication link is based on ultra-sound signals.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
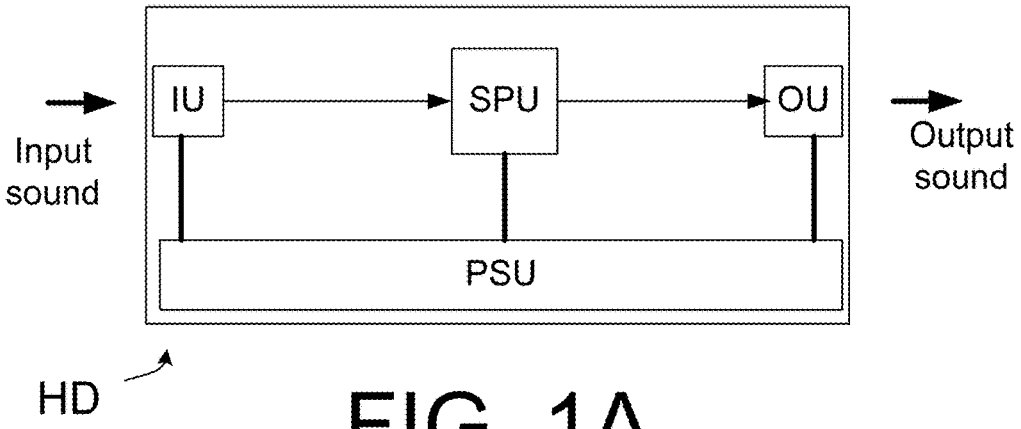
FIGS. 1A and 1B show two exemplary partitions of a hearing device, FIG. 1A illustrating a one-piece hearing device, and FIG. 1B illustrating a hearing device comprising $1^{st}$ and $2^{nd}$ modules according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

In an embodiment, a semi-permanent hearing device to be completely positioned within the ear canal for long term use is provided. The device is substantially positioned in the bony region of the ear canal within a predetermined small distance (small compared to the extension of an ear of the user, e.g. approximately 2-4 mm, e.g. adapted to a particular user) of the tympanic membrane for long-term wear of the hearing device in the ear canal (e.g. a number of weeks or months, e.g. up to 6 months or more).

A hearing device according to the present disclosure may e.g. compromise;

- A (second) core assembly module comprising:
  - Input, output and signal processing units for converting and processing sound waves incident thereon to audible signals to be imparted on the tympanic membrane of the wearer;
- A (first) sealing retainer module comprising:
  - A sealing retainer (e.g. a dome) fabricated and adapted to seat within and occlude the bony region of the ear canal of a user and to snugly support the core assembly along the longitudinal axis of the ear canal in the bony region when the hearing device is fully seated in the ear canal (whereby the sealing retainer module provides acoustic sealing of the bony region of the ear canal to prevent feedback);
  - A battery assembly including a battery for powering the hearing device;
- A sound port for receiving incoming sound and delivering the incoming sound to the input unit (e.g. a microphone) within the core assembly module when the (possibly disposable) sealing retainer module is connected to the core assembly module, thereby forming a modular hearing device. In this context it should be noted that the sealing container (also referred to as at least of part of the first module), preferably integrated the battery assembly into this container. That is, the sealing container and battery preferably together forms the first module.

The sound port preferably form part of the first or second module.

Figure 1B:
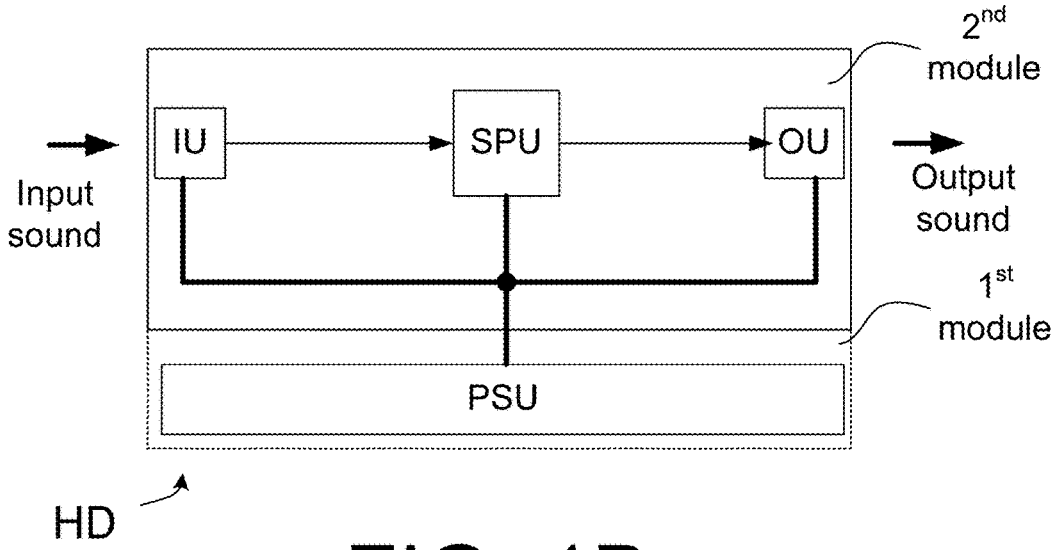

FIGS. 1A and 1B illustrates the basic components of a hearing device according to the present disclosure. FIG. 1A, 1B, respectively, show two exemplary partitions of a hearing device, FIG. 1A illustrating a one-piece hearing device, and FIG. 1B illustrating a hearing device comprising 1st and 2nd modules according to the present disclosure.

FIG. 1A schematically shows components of a hearing device HD configured to be placed in the ear canal of a user, the hearing device comprising a forward path adapted for processing an Input sound and providing an Output sound representative of the input sound (at least in a normal mode of operation). The hearing device comprises an input unit IU (e.g. an input transducer IT, such as a microphone), a signal processing unit SPU and an output unit OU (e.g. an output transducer OT, such as a loudspeaker) in operational connection. Input, output and signal processing units form part of (such as constitutes) the forward path of the hearing device. The hearing device further comprises a power supply unit PSU for energizing the hearing device, including the input IU and output OU units and the signal processing unit SPU. The supply of power to the individual functional units of the hearing device HD is illustrated by the bold line connections between the power supply unit PSU and the functional units in question (IU, SPU, OU).

FIG. 1B illustrates a partition of the hearing device of FIG. 1A according to the present disclosure. The hearing device HD of FIG. 1B comprises an assembly comprising $1^{st}$ and $2^{nd}$ modules adapted for being in mechanical and electrical contact with each other when the first and second modules are operationally assembled to form a functional unit (forming part of constituting the hearing device HD). The $1^{st}$ module comprises the power supply unit PSU, and the $2^{nd}$ module comprises an input unit IU, the signal processing unit SPU and the output unit OU in operational connection. The first and second modules ($1^{st}$ and $2^{nd}$ module) are configured to provide that the first and second modules are reversibly attachable to and detachable from each other, and electrically connected—when the first and second modules are operationally assembled—to provide that functional units of the $2^{nd}$ module are energized by the power supply unit PSU (e.g. a battery) of the $1^{st}$ module. In other words, when the $1^{st}$ and $2^{nd}$ modules are operationally assembled, the hearing device HD is energized by the power supply unit PSU (and fully functional), and when disassembled, no power to the functional units of the $2^{nd}$ module is provided by the power supply unit PSU (and the hearing device is not fully functional, e.g. partially or fully powered off). In an embodiment, the $2^{nd}$ module comprises an energy storage unit allowing a limited functionality of the (disassembled, separate) $2^{nd}$ module, e.g. for a limited time, e.g. to allow parameter settings or other limited functionality to be maintained.

Figure 2A:
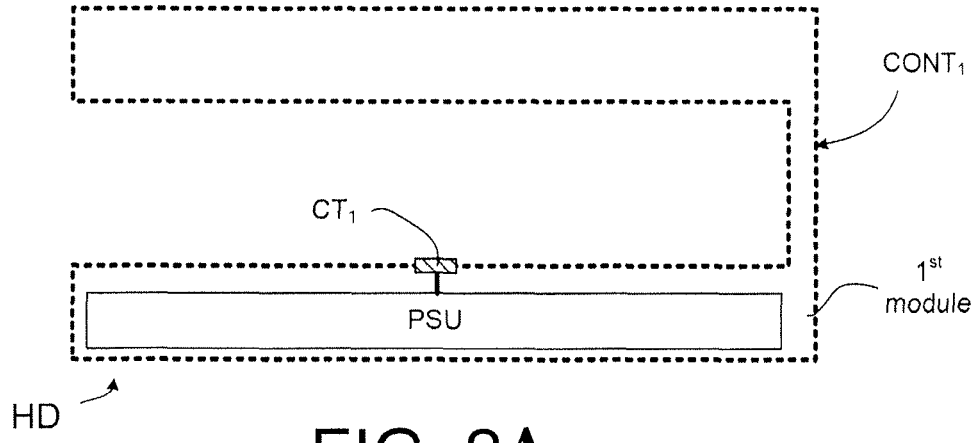
FIGS. 2A, 2B and 2C show an embodiment of a hearing device according to the present disclosure comprising separate first (FIG. 2A), and second (FIG. 2B) modules, FIG. 2C illustrating an operationally assembled hearing device.
Figure 2B:
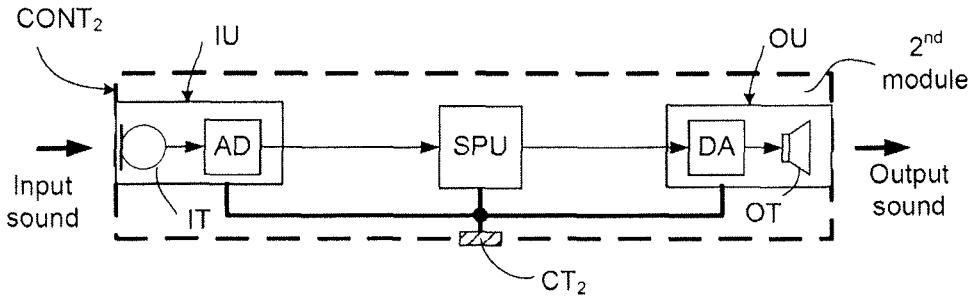
Figure 2C:
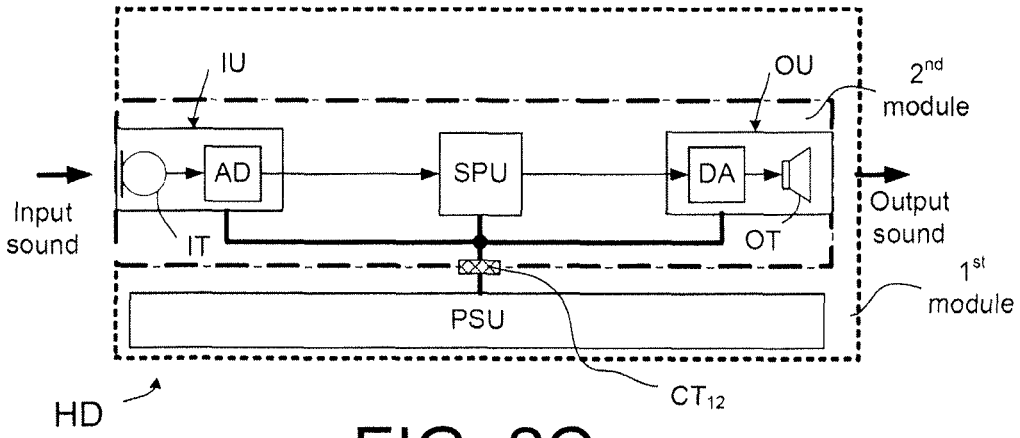

FIGS. 2A and 2B schematically shows an embodiment of a hearing device according to the present disclosure comprising separate first (FIG. 2A), and second (FIG. 2B) modules, FIG. 2C illustrating an operationally assembled hearing device. FIG. 2 illustrates an embodiment of hearing device substantially as shown in FIGS. 1A and 1B. In the embodiment of FIGS. 2A and 2B the input and output units (IU and OU, respectively) are illustrated in a more detail. The input unit IU comprises an input transducer IT and an analogue to digital conversion unit AD. The output unit OU comprises a digital to analogue conversion unit DA and an output transducer OT. Further, specific matching contact elements $CT_1$ (cf. FIG. 2A) and $CT_2$ (cf. FIG. 2B) of the $1^{st}$ and $2^{nd}$ modules, respectively, are illustrated. The contact elements $CT_1$ and $CT_2$ are configured to ensure a proper electric contact between the $1^{st}$ and $2^{nd}$ modules when they are operationally assembled. In assembled form, the matching contact elements $CT_1$ and $CT_2$ are denoted $CT_{12}$ (cf. FIG. 2C).

FIG. 2A illustrates the $1^{st}$ module comprising a first module container $CONT_1$ enclosing the power supply unit PSU. FIG. 2B illustrates the $2^{nd}$ module comprising a second module container $CONT_2$ enclosing the input unit IU, the signal processing unit SPU, and the output unit OU. The $1^{st}$ module container $CONT_1$ determines the outer extension (the volume) of the assembled $1^{st}$ and $2^{nd}$ modules (e.g. constituting the hearing device HD).

The $1^{st}$ and $2^{nd}$ module containers ($CONT_1$, $CONT_2$) are configured so that the $1^{st}$ module container $CONT_1$ circumvents or 'carries' the $2^{nd}$ module container $CONT_2$. This is e.g. achieved by adapting an opening or cavity of the $1^{st}$ module container $CONT_1$ to fittingly accommodate the $2^{nd}$ module container $CONT_2$. (while ensuring an electrical contact between contact elements $CT_1$ and $CT_2$ as illustrated by resulting contact element $CT_{12}$ in FIG. 2C when the $1^{st}$ and $2^{nd}$ modules are assembled). The cavity is shown not to be through-going (closed in the end where the output transducer is located, i.e. towards the ear drum), but may in other embodiments be through-going and/or have other forms than shown in FIG. 2. In the embodiment of FIG. 2, the closure at one end is used to ensure that the electric contacts of the $1^{st}$ and $2^{nd}$ modules are correctly positioned relative to each other (to ensure electrical contact between the two modules), when the $2^{nd}$ module is fully inserted into the $1^{st}$ module (so that the end faces are even at the open end of the cavity (where the input unit IU is located, when the $1^{st}$ and $2^{nd}$ modules are operationally assembled, as shown in FIG. 2C, left side of the drawing, where the Input sound is picked up by the input transducer IT).

FIG. 2C schematically illustrates the operationally assembled $1^{st}$ and $2^{nd}$ modules, where the $1^{st}$ and $2^{nd}$ module containers ($CONT_1$, $CONT_2$) are configured so that the $1^{st}$ module container $CONT_1$ circumvents or 'carries' the $2^{nd}$ module container $CONT_2$. The $1^{st}$ and $2^{nd}$ module containers ($CONT_1$, $CONT_2$) are configured to leave acoustic waves to and from the input and output transducers, respectively, largely un-attenuated. In the embodiment of FIG. 2, the $2^{nd}$ module container $CONT_2$ is configured to allow sound to reach the input transducer IT and sound to leave the output transducer OT, and the $1^{st}$ module container $CONT_1$ is configured to allow sound to leave the output transducer OT, as well. In general, the $1^{st}$ and/or $2^{nd}$ module (e.g. integrated in the respective containers) may comprise one or more filters for mechanically protecting respective acoustic inlets or outlets of the $2^{nd}$ module during use of the hearing device HD.

Figure 3A:
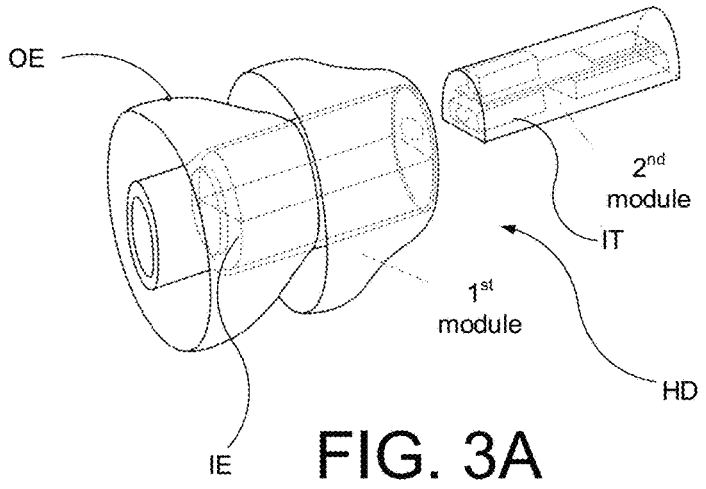
FIGS. 3A and 3B show in FIG. 3A an embodiment of a hearing device according to the present disclosure comprising $1^{st}$ and $2^{nd}$ modules in un-assembled form, and in FIG. 3B an embodiment of a hearing device according to the present disclosure comprising $1^{st}$ and $2^{nd}$ modules in assembled and operational form and located in an ear-canal of the user.
Figure 3B:
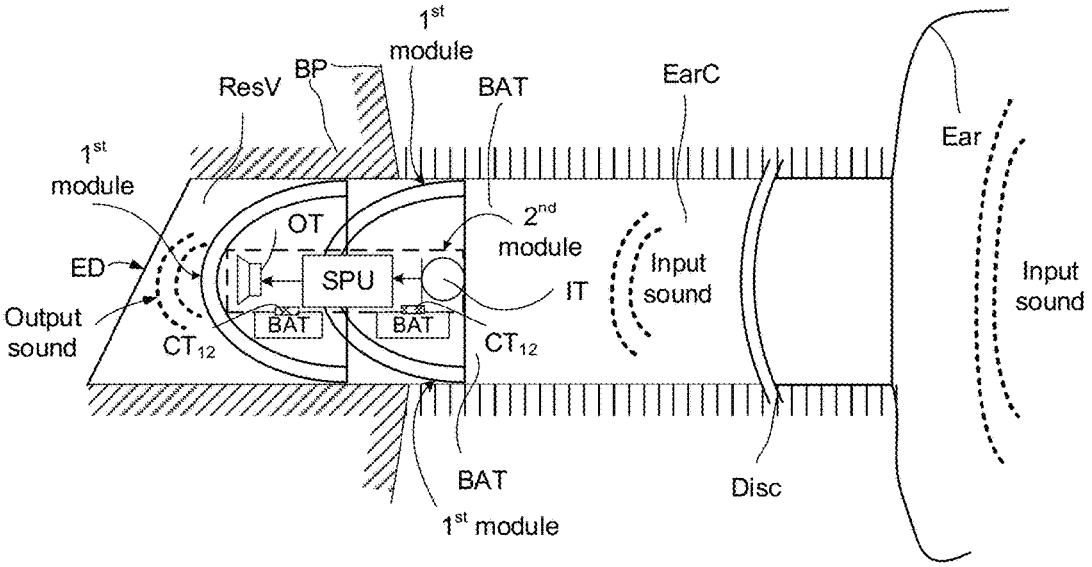

FIGS. 3A, 3B, respectively, show in FIG. 3A an embodiment of a hearing device according to the present disclosure comprising 1st and 2nd modules in unassembled form, and in FIG. 3B an embodiment of a hearing device according to the present disclosure comprising 1st and 2nd modules in assembled and operational form and located in an ear-canal of the user.

It should be noted that when talking about assembled and non-assembled form of the first and second module, it should be held in mind that the 1st and 2nd module is intended to be detachably and reverserbly connected in the context, that the 2nd module may be removed from the 1st module without destroying the outer contours or inner structures of the respective modules. That is, the 1st module is preferably intended to be disposed after end of use (for example when the power supply has run out of power), whereas the second module preferable is re-used in a second and preferable new 1st module. Thus, according to the disclosure here, the power supply module together with the first module is preferably intended to be thrown out after substantive use thereof, whereas the 2nd module, comprising the acoustic elements (such as the microphone, loudspeaker and processing units), is maintained for further use.

FIG. 3A shows an embodiment of a hearing device HD as schematically illustrated and described in connection with FIGS. 1A, 1B and 2A, 2B and 2C. In FIG. 3A a perspective 'look through' view of an exemplary embodiment of the hearing device is shown. The $1^{st}$ module comprises an inner tubular element IE configured to accommodate the $2^{nd}$, substantially cylindrical (with a substantially semi-circular cross section), module. The 1st module (e.g. the 1st module container) comprises two outer elements OE constituting a sealing retainer configured to be located fully or partially within and occlude the bony region of the ear canal of a user (cf. FIG. 3B) and to support the assembly along the longitudinal axis of the ear canal when the hearing device HD is operationally mounted. The two outer elements OE comprise a flexible (resilient) material (e.g. silicone or foam or rubber). The outer elements OE have the function of a dome or other structure (such as a foam sleeve) for spatially guiding the hearing device in the ear canal of the user. The inner element IE provides a mechanical interface towards the $2^{nd}$ module. The inner element IE is less mechanically flexible (e.g. has a smaller elastic modulus) than the outer element(s) OE (e.g. to ease the handling of assembly and disassembly of the $1^{st}$ and $2^{nd}$ modules, and to provide the assembled modules with an appropriate rigidity with a view to mounting and dismounting of the hearing device in and from the user's ear canal, respectively. The form and extension of the outer elements OE are adapted to ease an insertion of the hearing device in a user's ear canal (e.g. adapted in size to a particular user). The two 'dome like' outer elements are sequentially arranged along a common axis and have their curvature pointing in a direction of the ear drum when (being) mounted in an ear canal of the user to thereby guide and ease the process (and to reduce mechanical/acoustic feedback from the output transducer to the input transducer). This direction implied by the form of the $1^{st}$ module ($1^{st}$ module container) is termed output direction (referring to the propagation direction of output sound from the output unit of the hearing device) and the opposite direction the input direction (referring to the propagation direction of input sound to the input unit of the hearing device). Thereby respective input and output ends of the (elongate) hearing device are defined. At the input end (left side of FIG. 3A) a tubular structural element forms an inlet canal for sound thereby guided to the input transducer IT of the hearing device. The input end tubular structure may comprise a filter to minimize impurities (e.g. serumen) to reach the input transduce and thereby decrease its performance. The input end tubular structure may form an extension of the inner tubular element IE configured to accommodate the $2^{nd}$ module.

FIG. 3B schematically shows a hearing device HD according to an embodiment of the present disclosure when operationally mounted in the ear canal EarC of a user. The hearing device of FIG. 3B is e.g. a hearing device as described in connection with any of FIGS. 1A, 1B, 2A, 2B and 3A. The ear canal EarC extends inwards in the head towards the ear drum ED of the user from the outer ear (Pinna), denoted Ear in FIG. 3B. The ear canal is schematically drawn straight and with uniform cross-section along its length. This is generally not the case in practice, though. Its cross section and length (from inlet to ear drum) varies from person to person. A "not to scale indication" of the ear canal EarC is given by break signature denoted Disc in FIG. 3B. The hearing device HD comprising $1^{st}$ and $2^{nd}$ operationally assembled modules is operationally located (at least partially) in the bony part BP of the ear canal EarC. The Output sound from the output transducer OT of the $2^{nd}$ module plays into the residual volume ResV enclosed by the $1^{st}$ module and ear drum ED (and the walls of the ear canal). In the embodiment of a hearing device in FIG. 3B the $1^{st}$ module comprises two energizing elements BAT indicated to have separate contact elements $CT_{12}$ to ensure that electrical contact to the $2^{nd}$ module.

It should be understood from the disclosure, and the drawings that the power supply of the first element could similar comprise only one battery structure, wherein the battery structure comprises elements along its length for electrically connection with the second module. Thus, as illustrated in at least FIG. 3A a single battery could be used.

During normal operation of the hearing device HD an Input sound is picked up by the outer ear (Ear in FIG. 3B) of the user and guided to and through the ear canal EarC to be picked up by the input transducer IT (e.g. a microphone as indicated in FIG. 3B) converted to a corresponding electric input signal (e.g. digitized, cf. AD unit in FIG. 2), processed in signal processing unit SPU (e.g. to compensate for a hearing impairment of the user and/or a noisy or otherwise challenging acoustic environment), and a resulting processed signal is converted to an Output sound by output transducer OT (e.g. a loudspeaker as indicated in FIG. 3B). The Output sound impinges on the ear drum ED and excites the inner auditory system of the user.

Figure 4A:
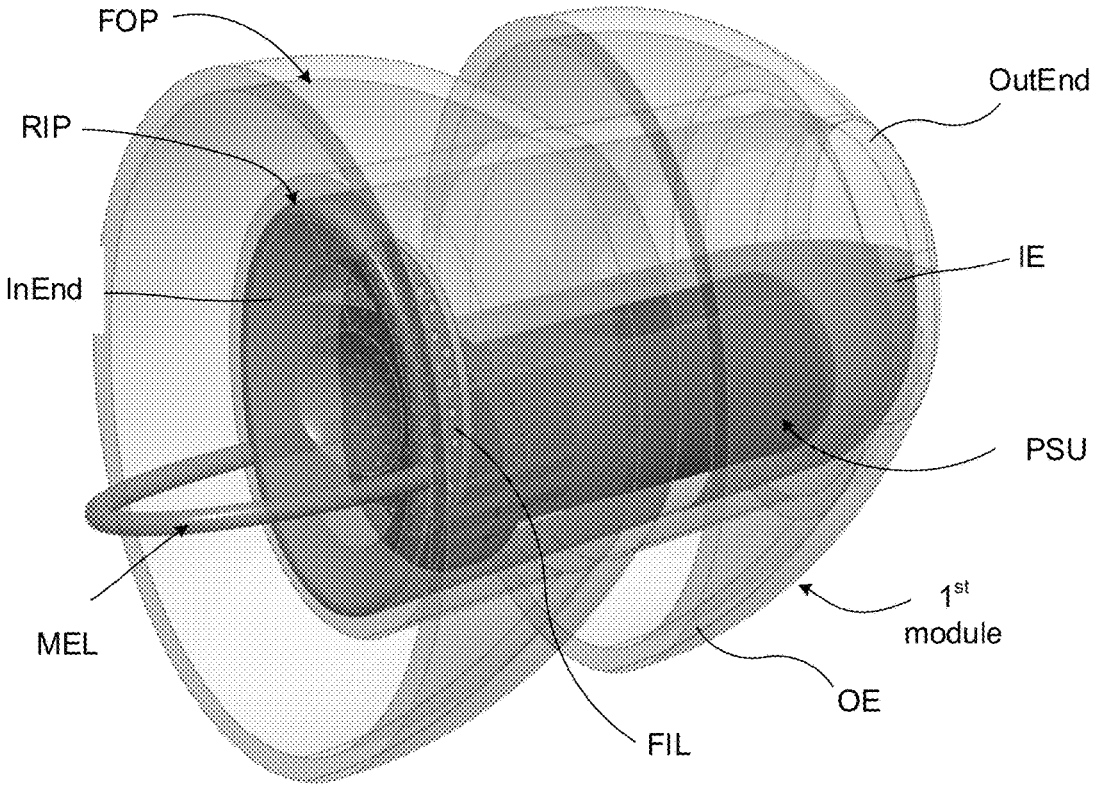
FIGS. 4A and 4B show embodiments of separate first (FIG. 4A) and second (FIG. 4B) modules of a hearing device according to the present disclosure.
Figure 4B:
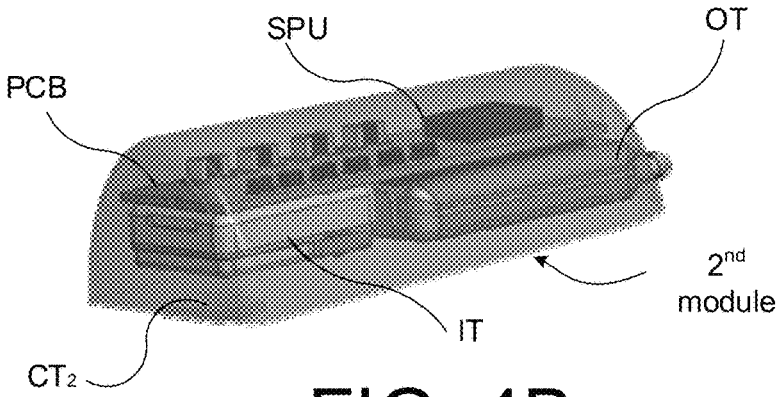

FIGS. 4A and 4B show embodiments of separate first (FIG. 4A) and second (FIG. 4B) modules of a hearing device according to the present disclosure. FIGS. 4A and 4B is similar to FIGS. 3A and 3B and illustrates the same elements, but in a slightly more physical view. The embodiment of a $1^{st}$ module of FIG. 4A additionally comprises a structural element MEL configured to allow a mounting and/or demounting of the assembled first and second modules in an ear canal of the use (cf. FIG. 3B). The structural element provides a pull-out and insertion interface to a mounting/dismounting tool for use when the hearing device is to be mounted or dismounted in or from an ear canal of the user. The input end InEnd and output end OutEnd of the hearing device and the inner IE and outer OE elements of the $1^{st}$ module are indicated. A filter FIL (e.g. a perforated wax filter) for protecting the input transducer is shown as an integral part of the $1^{st}$ module. The power supply unit PSU is located in the central part of the $1^{st}$ module along a longitudinal axis of the $1^{st}$ module in an appropriate position to be connected to the $2^{nd}$ module (via electrical contact $CT_1$ (and $CT_2$ of the $2^{nd}$ module)) and with a view to mechanical stability and peripheral flexibility (to adapt to the varying form of the ear canal). The cavity or opening in the $1^{st}$ module is adapted to receive the $2^{nd}$ module (FIG. 4B) when inserted from the output end OutEnd. The $1^{st}$ and $2^{nd}$ modules are designed so that contact elements $CT_1$ and $CT_2$ meet and create electrical connection between the two modules when the $2^{nd}$ module is properly inserted into the $1^{st}$ module.

In an similar embodiment (not shown), it should be understood that the configuration of the hearing device could similarly designed such that the InEnd is open to the outside on at least a part thereof creating a substantially throughgoing cavity. Thus, in a similar manner as previously described, the InEnd is configured to receive the second module upon assembly of the hearing device into an operational state. It is thus possible that both the input end and the output end could be used for insertion of the second module into the cavity of the first module. In more detail, FIG. 4B illustrates the $2^{nd}$ module comprising input transducer IT, output transducer OT and signal processing unit SPU in operational connection via electrical conductors fully or partially located on a carrier substrate, e.g. a PCB. In addition to the (e.g. digital) signal processing unit SPU, other components (e.g. forming part of one or more analogue interface circuits) may be located on the carrier substrate as schematically indicated in FIG. 4B. The electrical contact element $CT_2$ for connecting the components of the $2^{nd}$ module to the power supply unit PSU of the $1^{st}$ module is indicated at the planar (bottom) part of the cylindrically formed $2^{nd}$ module container (having a semi-circular cross section).

In a further exemplary embodiment of the disclosure (not illustrated in any more detail), the printed circuitry board could be a substantially flexible circuitry board, which are able to fold or bend along its structure, so as for example to be arranged around different parts of at least the second module. In this way the flexible printed circuitry board (PCB) would in effect provide the hearing aid with a generally more flexible behavior within the ear canal. If providing a substantially more flexible and bendable flexible print, less space would be needed to accommodate the different part of the deep in the ear hearing device. Thus, which such solution a deep in the ear hearing device could be designed so as to optimize the comfort of the user wearing such device. It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP2538701A2 (OTICON).

U.S. Pat. No. 8,630,434B2 (OTICON).

The invention claimed is:

1. A hearing device configured to be placed in the ear canal of a user, the hearing device comprising a forward path adapted for processing an input sound and providing an output sound representative of the input sound, the hearing device comprising an assembly comprising a disposable power supply module and a reusable acoustic module adapted for being in mechanical contact with each other when the hearing device is operationally assembled to form a functional unit, wherein the power supply module comprises a mechanically flexible outer surface shaped to guide insertion of the hearing aid deep into the ear canal of the user so as to reach a part of the bony region, an inner surface shaped as an elongated cavity that receives and fittingly accommodates the acoustic module therein, the inner surface including a first contact element, and a power supply unit in the form of a battery integrated into the structure of the power supply module, the battery being in direct contact with the first contact element, and the acoustic module comprises a second contact element, an input unit, a signal processing unit and an output unit in operational connection, wherein the power supply and acoustic modules are configured to provide that the power supply and acoustic modules are reversibly attachable to and detachable from each other; and the power supply and acoustic modules are electrically connected via direct contact between the first and second contact elements to provide that units of the acoustic module are energized by the battery of the power supply module, when the power supply and acoustic modules are operationally assembled, wherein said cavity of said power supply module fittingly accommodates said acoustic module in a removable manner.

2. The hearing device according to claim 1 wherein the power supply module comprises a first module container enclosing the power supply unit, and the acoustic module comprises a second module container enclosing the input unit, the signal processing unit, and the output unit.

3. The hearing device according to claim 2 configured to provide that the power supply module carries the acoustic module, when the power supply and acoustic modules are operationally assembled.

4. The hearing device according to claim 2 configured to provide that the power supply module encloses the acoustic module, when the power supply and acoustic modules are operationally assembled.

5. The hearing device according to claim 2 wherein the input unit comprises an input transducer for converting an input sound to an electric input audio signal, and the output unit comprises an output transducer for converting a processed audio signal to an output sound.

6. The hearing device according to claim 2, wherein an inner surface of said first module container surrounds an outer surface of said second module container.

7. The hearing device according to claim 2, wherein an inner surface of said first module container includes a contact element that aligns with a contact element included on an outer surface of said second module container when said second module is fully inserted in said cavity of said first module.

8. The hearing device according to claim 1 configured to provide that the power supply module carries the acoustic module, when the power supply and acoustic modules are operationally assembled.

9. The hearing device according to claim 8 configured to provide that the power supply module encloses the acoustic module, when the power supply and acoustic modules are operationally assembled.

10. The hearing device according to claim 8 wherein the input unit comprises an input transducer for converting an input sound to an electric input audio signal, and the output unit comprises an output transducer for converting a processed audio signal to an output sound.

11. The hearing device according to claim 1 configured to provide that the power supply module encloses the acoustic module, when the power supply and acoustic modules are operationally assembled.

12. The hearing device according to claim 1 wherein the input unit comprises an input transducer for converting an input sound to an electric input audio signal, and the output unit comprises an output transducer for converting a processed audio signal to an output sound.

13. The hearing device according to claim 1 configured to allow an input sound from the local environment of the input unit of the hearing device to reach the input unit and output sound from the output unit of the hearing device to reach the local environment of the output unit.

14. The hearing device according to claim 1 wherein the mechanically flexible outer surface of the power supply module is configured to provide a resilient interface towards walls of the ear canal of the user.

15. The hearing device according to claim 1 wherein the power supply module comprises an inner part that provides a mechanical interface towards the acoustic module, wherein the inner part is less mechanically flexible than the outer surface.

16. The hearing device according to claim 1 wherein the power supply module comprises one or more filters for mechanically protecting respective inlets or outlets of the acoustic module during use of the hearing device.

17. The hearing device according to claim 1 wherein the forward path of the acoustic module being energized from the power supply unit of the power supply module consists of a microphone for picking up an input sound from the environment and providing an electric input signal, the signal processing unit for processing the electric input signal and providing a processed electric signal, and a loudspeaker for converting the processed electric signal to an output sound.

18. The hearing device according to claim 1 configured to be powered on during wear.

19. The hearing device according to claim 1 configured to be automatically set in a reduced power mode when a predefined criterion is fulfilled.

20. The hearing device according to claim 1 comprising a first structural element for mounting and/or dismounting the hearing device in and from, respectively, the ear canal of the user.

21. A hearing system comprising the hearing device according to claim 1 and an auxiliary device adapted to establish a communication link between the hearing device and the auxiliary device to provide that information can be exchanged or forwarded from one to the other.

22. The hearing device according to claim 1, wherein said cavity is closed on one end of said power supply module.

23. The hearing device according to claim 1, wherein said hearing device is configured to be positioned at least partially in the bony portion of the ear canal of the user.

24. The hearing device according to claim 1, wherein the inner surface of the power supply module includes multiple first contact elements, multiple batteries are integrated into the structure of the power supply module, said multiple batteries being respectively in direct contact with the multiple first contact elements, and the power supply and acoustic modules are electrically connected via direct contact between at least one of the multiple first contacts and the second contact.

25. The hearing device according to claim 1, wherein the acoustic module is configured to be inserted into, and removed from, the cavity of power supply module in a given direction, the power supply module is configured to cover each side of the acoustic module parallel to the given direction including the top and bottom of the acoustic module.

* * * * *